US007683871B2

(12) United States Patent
Kato

(10) Patent No.: US 7,683,871 B2
(45) Date of Patent: Mar. 23, 2010

(54) DISPLAY CONTROL CIRCUIT

(75) Inventor: Fumihiko Kato, Yamagata (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 1061 days.

(21) Appl. No.: 11/362,138

(22) Filed: Feb. 27, 2006

(65) Prior Publication Data

US 2006/0192793 A1 Aug. 31, 2006

(30) Foreign Application Priority Data

Feb. 28, 2005 (JP) ..... 2005-055029

(51) Int. Cl.
*G09G 3/36* (2006.01)

(52) U.S. Cl. ..... 345/89; 345/98; 345/204; 341/144; 330/67

(58) Field of Classification Search ..... 345/76, 345/77, 87, 89, 98, 100, 204, 690; 341/144, 341/150; 330/67
See application file for complete search history.

(56) References Cited

U.S. PATENT DOCUMENTS 5,648,791 A 7/1997 Date et al.
6,310,593 B1 * 10/2001 Nakao ..... 345/87
6,784,865 B2 * 8/2004 Akimoto et al. ..... 345/98
6,982,706 B1 * 1/2006 Doi et al. ..... 345/206
7,136,058 B2 * 11/2006 Nakamura et al. ..... 345/211
7,196,685 B2 * 3/2007 Lee et al. ..... 345/99
7,382,344 B2 * 6/2008 Lee et al. ..... 345/99
7,474,306 B2 * 1/2009 Doi et al. ..... 345/206
7,595,776 B2 * 9/2009 Hashimoto et al. ..... 345/76
2005/0168416 A1 * 8/2005 Hashimoto et al. ..... 345/76
2006/0238477 A1 * 10/2006 Lew et al. ..... 345/94
2007/0040855 A1 * 2/2007 Kato ..... 345/690

FOREIGN PATENT DOCUMENTS

JP 9-138670 5/1997

OTHER PUBLICATIONS

English-Language translation of Chinese Office Action dated Mar. 21, 2008.

* cited by examiner

*Primary Examiner*—Sumati Lefkowitz
*Assistant Examiner*—Seokyun Moon
(74) *Attorney, Agent, or Firm*—McGinn IP Law Group, PLLC

(57) ABSTRACT

A display control device of the present invention includes a gamma circuit producing and outputting a gray scale voltage and a selection drive circuit selecting the gray scale voltage on the basis of a pixel data displayed on a display device and outputting the selected gray scale voltage as a pixel driving signal to the display device. The selection drive circuit includes an analog memory and holds the selected gray scale voltage in the analog memory.

3 Claims, 11 Drawing Sheets

DISPLAY CONTROL CIRCUIT

BACKGROUND OF THE INVENTION

1. Field of the Invention

The present invention relates to a display control circuit for drivingly controlling a display device.

2. Description of Related Art

A conventional LCD (liquid crystal display) panel for a display device is disclosed, for example, in Japanese. Patent Laid-Open No. 9-138670. Referring to FIG. 14, the conventional LCD panel will be described below.

FIG. 14 illustrates a display panel 30 and a display control circuit 9 for displaying data on the display panel. The display control circuit 9 includes a gamma circuit 10 and gray scale selection drive circuits 29-1 to 29-N, where N is the number of pixels for one line of the display panel. The gray scale selection drive circuit 29-1 includes a decoder circuit 24-1, a gray scale selector circuit 22-1 and a drive circuit 49-1. Each of the gray scale selection drive circuits 29-2 to 29-N has the same configuration as the gray scale selection drive circuit 29-1, the description of which is omitted. A portion subsequent to a symbol "–" indicates its circuit number and is omitted for description if the circuits are not required to be distinguished from each other.

The display panel 30 can be modelized as a panel load for each drive line. The panel load 31 can be simulated by a resistor 34 and a capacitor 35.

The gamma circuit 10, as illustrated in FIG. 2, includes resistors R1 to R16 and switches S1 to S16. Resistors R1 to R16 are connected in series and reference voltages Vref1 to Vref2 are resistively divided to produce gray scale voltages V1 to V16. That is, gray scale voltages Vi and Vi+1 are produced across a resistor Ri. Gray scale voltages V2m and V2m−1 are outputted into one gray scale wiring VTm as a result of switches S(2m) and S(2m−1) being switched by a gray scale change-over timing signal. In other words, the gamma circuit 10 switches the gray scale voltages to even-numbered gray scale (2m gray scale) and odd-numbered gray scale (2m−1 gray scale) for output. The switching is performed with the gray scale change-over timing signal CK as a synchronous signal and the gray scale voltages V2m and V2m−1 undergo time division multiplexing to be transmitted through the gray scale wiring VTm.

A decoder 24 outputs a gray scale selection signal DT indicating a gray scale to be selected into a gray scale selector circuit 22 on the basis of a display data D and a gray scale change-over timing signal CK. The decoder 24 outputs a switch change-over signal ϕ for controlling switching of a switch 48 into a drive circuit 49.

The gray scale selector circuit 22 outputs a selected selection gray scale signal VTM into the drive circuit 49. The drive circuit 49 includes an amplifier 41 and the switch 48. The amplifier 41 power-amplifies the selected gray scale signal VTM. The switch 48 outputs a driving signal VO outputted from the amplifier 41 at a timing based on a switch change-over signal ϕ.

The driving signal VO is transmitted to the display panel 30 and charges and discharges a capacitor 35 through a resistor 34. The brightness of a pixel varies with a voltage of the capacitor 35, so that a display data is displayed.

This conventional display device displays a display data on the panel using a pre-charge period for pre-charging a pixel 31 and a data display period corresponding to a pixel data.

During the pre-charge period, the gray scale selector circuit selects and outputs a gray scale voltage corresponding to a predetermined even-numbered gray scale V2m of gray scales corresponding to data. Accordingly, a voltage of an even-numbered gray scale corresponding to a display data is transmitted to the display panel 30 as a driving signal VO. The voltage of the transmitted driving signal VO is held in a capacitor/wiring capacitance 35 of the display panel 30.

Subsequently, with a data to be displayed having an even-numbered gray scale V2m, the switch 48 is released during a data display period. Releasing the switch 48 shuts down driving of the drive circuit 49 for the display panel 30, thus holding a voltage held in the wiring capacitance 35 of the display panel 30. On the basis of the voltage, a display data is displayed.

With a data to be displayed having an odd-numbered gray scale voltage V2m−1, the switch 48 is kept closed during a data display period. The gray scale selector circuit 22 outputs the odd-numbered gray scale voltage V2m−1 in accordance with data and the outputted voltage is transmitted to the display panel 30 as a driving signal VO through the drive circuit 49. On the basis of the voltage of the driving signal VO, a display data is displayed.

A gray scale voltage Vi corresponding to the display data D is transmitted to the display panel 30 in this way. However, an even-numbered voltage V2m is displayed during a data display period, no electric current is transmitted from a driver 9 because the switch 48 is off. Accordingly, a voltage of a wiring capacitance 35 may be changed by a leak current generated on the display panel 30 side. This causes a problem of generation of a color error.

SUMMARY OF THE INVENTION

In view of the aforementioned problem, it is an object of the present invention to restrain fluctuations in gray scale voltages, thus providing better image quality without color errors. To achieve the aforementioned object, a display control device according to the present invention includes gamma circuits (10, 11) and selection drive circuits (20, 21). Each of the gamma circuits (10, 11) produces a gray scale voltage (Vi). Each of the selection drive circuits (20, 21) selects the gray scale voltage (Vi) outputted from the gamma circuits (10, 11) based on the pixel data displayed on the display device.(30) and outputs the selected gray scale voltage to a display device (30) as a pixel driving signal (VO). Each of the selection drive circuits (20, 21) includes an analog memory (43) and holds a selected gray scale voltage in the analog memory (43). The analog memory stores/reproduces a voltage in an analog manner, so that a stored gray scale voltage becomes steady.

Each of the gamma circuits (10, 11) according to the present invention outputs a plurality of gray scale voltages in a time division manner. The selection drive circuit stores a display gray scale voltage predetermined in-accordance with a pixel data of the plurality of gray scale voltages inputted in a time division manner into an analog memory. The plurality of gray scale voltages are an even-numbered gray scale voltage (V2m) and an odd-numbered gray scale voltage (V2m−1) of gray scale voltages (Vi) produced by the gamma circuits (10, 11) and are respective gray scale voltages (VRi, VGi, VBi) having predetermined gray scales of a plurality of primary colors. The gray scale voltages of primary colors may be further multiplexed with even-numbered gray scales and odd-numbered gray scales for transmission. Multiplexing with even-numbered/odd-numbered gray scales reduces the number of gray scale wirings (VTi) to ½, while the multiplexing with gray scales of primary colors reduces the number of gray scale wirings to ⅓ if three primary colors are used.

According to another aspect of the present invention, there is provided a display control method for displaying a display data on a display device and includes a production step, transmission step, a selection step, a storage step and a drive step. The production step produces a gray scale voltage. The transmission step time-divides a plurality of produced gray scale voltages for transmission. The selection step selects one of the plurality of transmitted gray scale voltages on the basis of a display data. A storage step stores one of the plurality of gray scale voltages selected in accordance with the selection step. The drive step selects either of the gray scale voltage selected in accordance with the selection step or a gray scale voltage stored in accordance with the storage step and amplifies the gray scale voltage for output.

BRIEF DESCRIPTION OF THE DRAWINGS

This above-mentioned and other objects, features and advantages of this invention will become more apparent by reference to the following detailed description of the invention taken in conjunction with the accompanying drawings, wherein.

DETAILED DESCRIPTION OF THE PREFERRED EMBODIMENTS

Reference will now be made in detail to preferred embodiments of the present invention, examples of which are illustrated in the accompanying drawings.

First Embodiment

Figure 1:
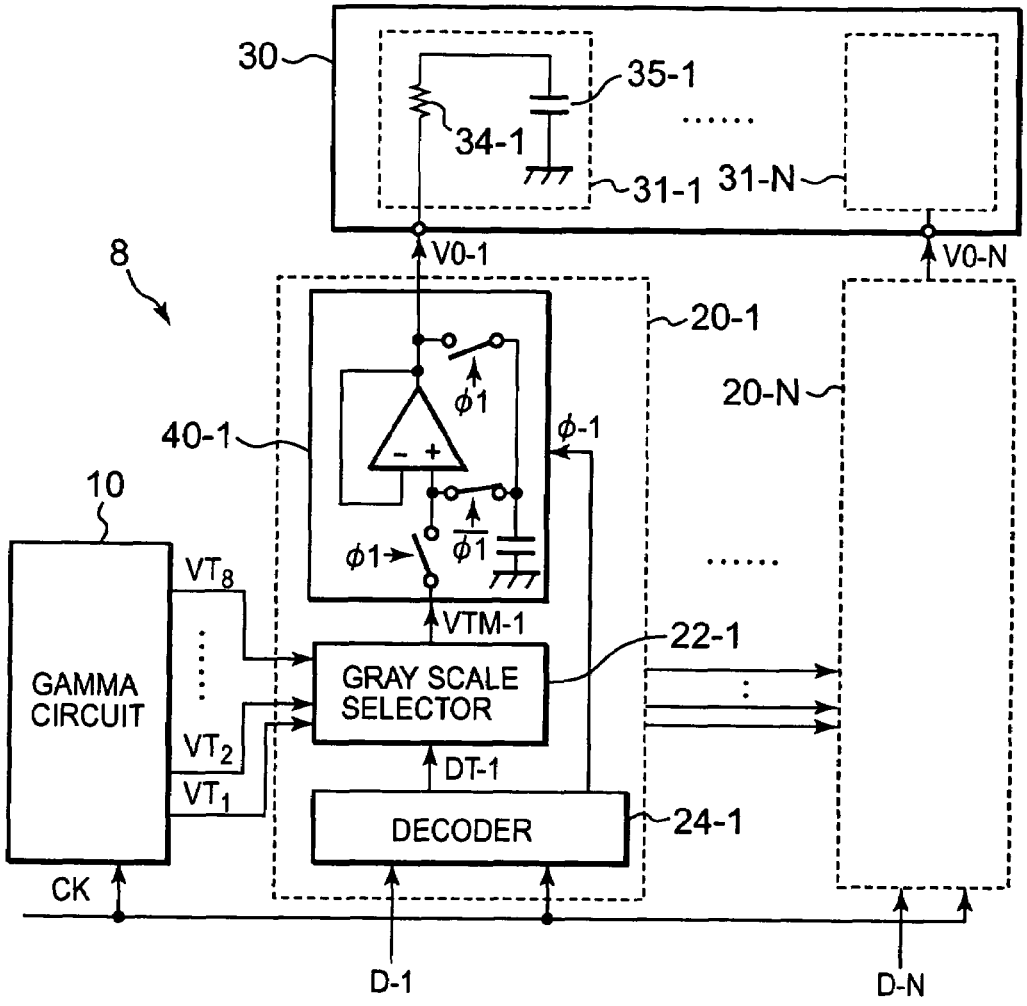
FIG. 1 is a schematic block diagram illustrating a configuration of a display control circuit and a display panel according to a first embodiment of the present invention.
Figure 2:
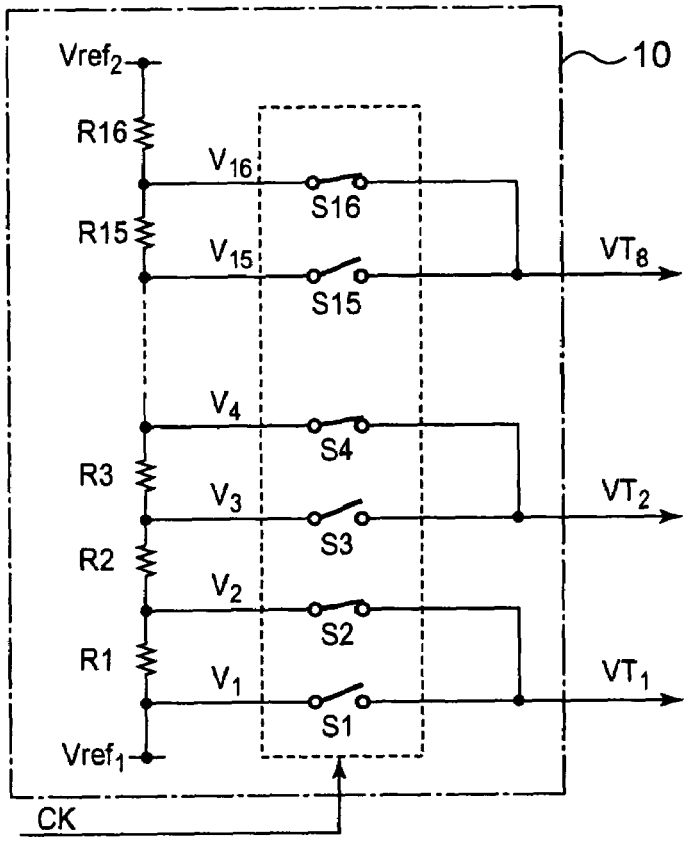
FIG. 2 is a diagram illustrating a configuration of a gamma circuit according to a first embodiment of the present invention.

Referring to FIGS. 1 to 4, a first embodiment of the present invention will be described below. FIG. 1 is a block diagram illustrating a configuration of a display control circuit and a display panel according to the present invention, where the display panel 30 illustrates a device which performs a 16-gray scale display of a single color. The display control circuit 8 includes the gamma circuit 10 and gray scale selection drive circuits 20-1 to 20-N to display data D-1 to D-N on the display panel 30. A configuration consisting of components except the gray scale selection drive circuit 20 is the same of that described in the conventional art, description of which is omitted herein.

The gray scale selection drive circuit 20-1 includes a decoder circuit 24-1, a gray scale selector circuit 22-1 and a drive circuit 40-1.

The gray scale selector circuit 22-1 outputs gray scale voltages V1 to V16 to the drive circuit 40-1 as a selected gray scale signal VTM-1 in response to a gray scale selection signal DT-1. The drive circuit 40-1 outputs a driving signal VO-1 obtained by power-amplifying the selected gray scale signal VTM-1 to the display panel 30. The gray scale selection drive circuits 20-2 to 20-N have the same configuration as that of the gray scale selection drive circuit 20-1 respectively, description of which is omitted.

To the decoder circuit 24-1, the display data D-1 and a gray scale change-over timing signal CK are transmitted. The decoder circuit 24-1 outputs a gray scale selection signal DT-1 obtained by decoding an image data to the gray scale selector circuit 22-1. Moreover, the decoder circuit 24-1 outputs a switch change-over signal ϕ-1 corresponding to the least significant bit of an image data to the drive circuit 40-1.

With a display data D of "1111", a voltage of a driving signal VO for driving the display panel 30 corresponds to a gray scale voltage V16 and, with a display data D of "0000", a voltage of a driving signal VO corresponds to a gray scale voltage V1. In other words, if the least significant bit is "1", it indicates an even-numbered gray scale and, if the least significant bit is "0", it indicates an odd-numbered gray scale.

For example, if a display data D="1111" is given, the decoder circuit 24 outputs a gray scale selection signal DT selecting a gray scale wiring VT8 for supplying a gray scale voltage V16 (2m:m=8) of an even-numbered gray scale. On the other hand, the gray scale wiring VT8 supplies a gray scale voltage V15 (2m−1:m=8) when a gray scale change-over timing signal CK is at a high level.

If a display data D="1110" is given, the decoder circuit 24 outputs a gray scale selection signal DT selecting a gray scale wiring VT8 for supplying a gray scale voltage V15 (2m−1:m=8) of an odd-numbered gray scale. The gray scale wiring VT8 supplies a gray scale voltage V15 (2m−1:m=8) when a gray scale change-over timing signal CK is at a high level. That is, the same gray scale wiring VT8 as for "1111" is selected.

Figure 3:
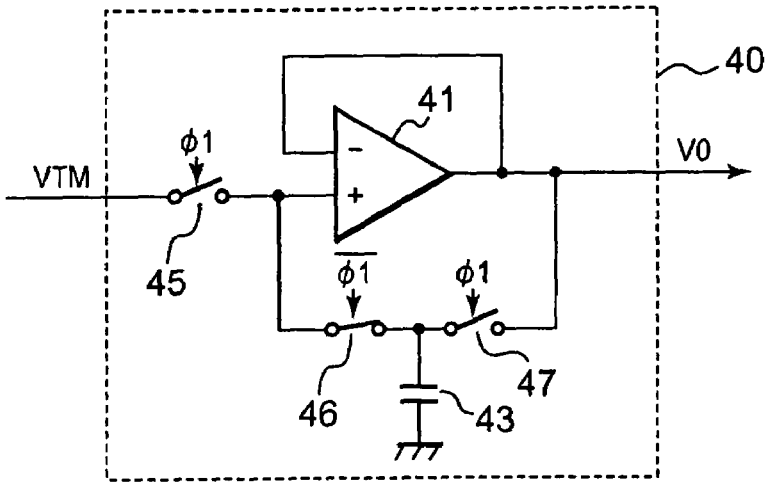
FIG. 3 is a diagram illustrating a configuration of a drive circuit according to first and second embodiments of the present invention.

The drive circuit 40, as illustrated in FIG. 3, includes an amplifier 41, a capacitor 43 and switches 45 to 48. A selected gray scale signal VTM inputted into the drive circuit 40 is connected to a non-reversed input terminal of the amplifier 41 and a switch 46 through the switch 45. The other terminal of the switch 46 is connected to the switch 47 and the capacitor 43. The other terminal of the capacitor 43 is grounded. The other terminal of the switch 47 is connected to the switch 48, an output terminal and a reversed input terminal of the amplifier 41. The other terminal of the switch 48 is an output terminal of the drive circuit 40 and is connected to the display panel 30. The amplifier 41 drives a load of the display panel 30 by performing signal power amplification. The capacitor 43 is charged by the switches 45 to 47 to be opened and closed and holds a charged voltage. That is, the capacitor 43 functions as an analog memory.

The switches 45 to 47 are opened and closed in response to a switch change-over signal ϕ. With the switch change-over signal ϕ at a high level, the switches 45 and 47 turn on and the switch 46 turns off. With the switch change-over signal ϕ at a low level, the switches 45 and 47 turn off and the switch 46 turns on.

Figure 4:
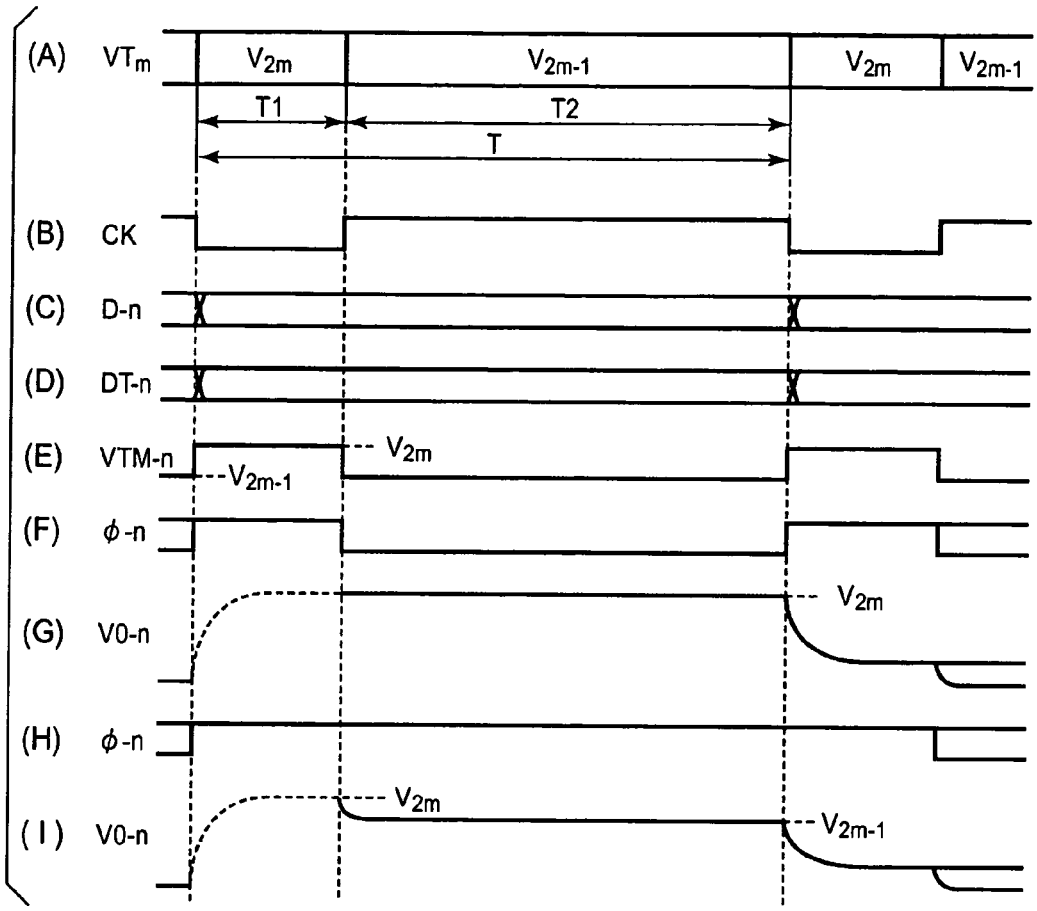
FIG. 4 is a time chart illustrating operation of a display control circuit according to a first embodiment of the present invention.

Referring to FIG. 4, the operation of the display control circuit 8 will be described below. FIG. 4 illustrates timings of respective signals in a gray scale selection drive circuit 20-n of the display control circuit 8. FIG. 4A illustrates a state of a gray scale voltage supplied by a gray scale wiring VTm. FIG. 4B illustrates a gray scale change-over timing. FIG. 4C illustrates a display data D-n inputted into a gray scale selection drive circuit 20-n. FIG. 4D illustrates a gray scale selection signal DT-n outputted from a decoder circuit 24-n. FIG. 4E illustrates a selected gray scale signal VTM-n outputted from a gray scale selector circuit 22-n. FIGS. 4F and 4G illustrate a switch change-over signal ϕ-n and a driving signal VO-n obtained when a display data D-n is an even-numbered gray scale data. FIGS. 4H and 4I illustrate a switch change-over signal ϕ-n and a driving signal VO-n obtained when a display data D-n is an odd-numbered gray scale data.

A period for which one line of the display panel 30 is displayed refers to one horizontal period, which is indicated with a period T in FIG. 4. The one horizontal period T corresponds to one cycle of a gray scale change-over timing signal CK. As illustrated in FIG. 4A, the one horizontal period T is divided into a period T1 and a period T2. The period T1 indicates a period for which a gray scale change-over timing signal CK is low, or a period for which an even-numbered gray scale voltage V2m is supplied to a gray scale wiring VTm. The period T2 indicates a period for which a gray scale change-over timing signal CK is high, or a period for which an odd-numbered gray scale voltage V2m−1 is supplied to the gray scale wiring VTm. As illustrated in FIGS. 4B and 4C, the gray scale change-over timing signal CK is synchronized with a change-over timing of a display data D-n. That is, a period between change-over timings of the display data D-n is one cycle of the gray scale change-over timing signal CK.

After a display data D-n is supplied, a decoder circuit 24-n decodes upper three bits of the display data D-n and outputs a gray scale selection signal DT-n for designating a gray scale wiring VT to be selected to the gray scale selector 22-1. The gray scale selection signal DT-n will not change until the display data D-n makes the next change.

On the other hand, a decoder circuit 24-n, as illustrated in FIGS. 4F and 4H, sets a switch change-over signal ϕ-n at a high level during a period T1 for which a gray scale change-over timing signal CK is at a low level. The switch change-over signal ϕ-n is transmitted to a drive circuit 40-n. That is, during a period T1, the switches 45, 47 are closed and the switch 46 is opened. Accordingly, a selected gray scale signal VTM inputted through the switch 45 is power-amplified by the amplifier 41 having a voltage follower configuration, so that the capacitor 43 is charged and discharged through the switch 47, as shown by dashed lines (G) (I) in FIG. 4.

During a period T2, a gray scale voltage supplied to a gray scale selector circuit 22-n by a gray scale wiring VTm from the gamma circuit 10 becomes an odd-numbered gray scale voltage V2m−1 as illustrated in FIG. 4A. Because a display data D-n inputted into a decoder circuit 24-n remains unchanged in the same way as during the period T1, a gray scale selection signal DT-n obtained by decoding three upper-order bits also makes no changes. The gray scale selector circuit 22-n selects the same gray scale wiring VTm as during the period T1, however, a gray scale voltage to be supplied becomes an odd-numbered gray scale voltage V2m−1. Accordingly, the selected gray scale signal VTM-n outputted from a gray scale selector circuit 22-n changes into an odd-numbered gray scale voltage V2m−1 as illustrated in FIG. 4E.

During a period T2 of a gray scale change-over timing signal CK at a high level, a decoder circuit 24-n produces a switch change-over signal ϕ-n on the basis of the least significant bit of a display data D-n and the gray scale change-over timing signal CK.

When the least significant bit of the display data D-n is "1", or when the display data D-n indicates an even-numbered gray scale, a switch change-over signal +-n is at a low level as illustrated in FIG. 4F. The switch change-over signal ϕ-n is transmitted to the drive circuit 40 for switch change-over. When the switch change-over signal ϕ-n is at a low level, the switches 45, 47 are opened and the switch 46 is closed. Accordingly, a voltage charged in the capacitor 43 is applied to the amplifier 41 through the switch 46. During a period T2, the amplifier 41 outputs an even-numbered gray scale voltage V2m stored during a period T1. An input impedance of the amplifier 41 configured in a voltage follower form can be set so as to be high. Accordingly, there are few electric currents leaking from the capacitor 43, and a drop in a charging voltage is negligible. Thus, a stable gray scale voltage can be supplied to the display panel 30.

When the least significant bit of a display data D-n is "0", or when the display data D-n indicates an odd-numbered gray scale, a switch change-over signal ϕ-n remains unchanged at a high level as illustrated in FIG. 4H. Accordingly, the switches 45 to 47 of the drive circuit 40 remains unchanged in the same state as during a period T1. That is, a selected gray scale signal VTM-n to be inputted is power-amplified by the amplifier 41 and, as illustrated in FIG. 4I, an odd-numbered gray scale voltage V2m−1 is outputted.

In this way, a gray scale voltage produced by the gamma circuit 10 is switched to an even-numbered gray scale voltage V2m and an odd-numbered gray scale voltage V2m−1, which is transmitted over a gray scale wiring VTm. Thus, the gray scale wiring VTm becomes ½ as large as the number of gray scales. As described above, providing an analog memory consisting of the capacitor 43 and the switches 45 to 47 permits the gray scale selection drive circuit 20 to output a driving signal VO for maintaining a gray scale voltage so as to be stable even if the gray scale voltage is switched over the gray scale wiring VTm. Accordingly, because fluctuations in gray scale voltages to be outputted are restrained, better image quality can be achieved without any color error.

Although, in the above case, gray scale voltages outputted from the gamma circuit 10 are described as those that are divided into even-numbered and odd-numbered gray scale voltages for multiplexed supply, other combinations can provide multiplexing.

Second Embodiment

Figure 5:
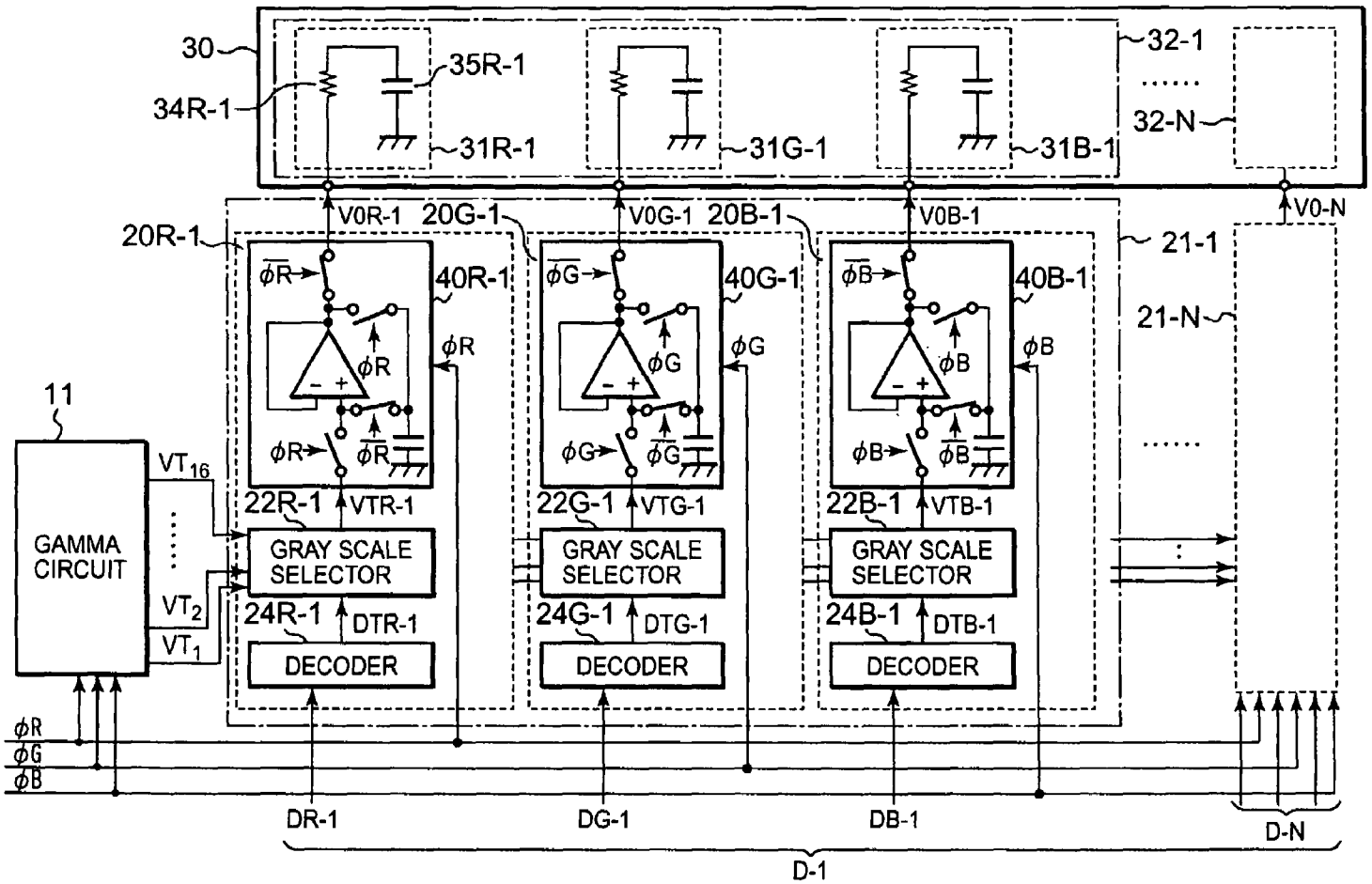
FIG. 5 is a schematic block diagram illustrating a configuration of a display control circuit and a display panel according to a second embodiment of the present invention.
Figure 6:
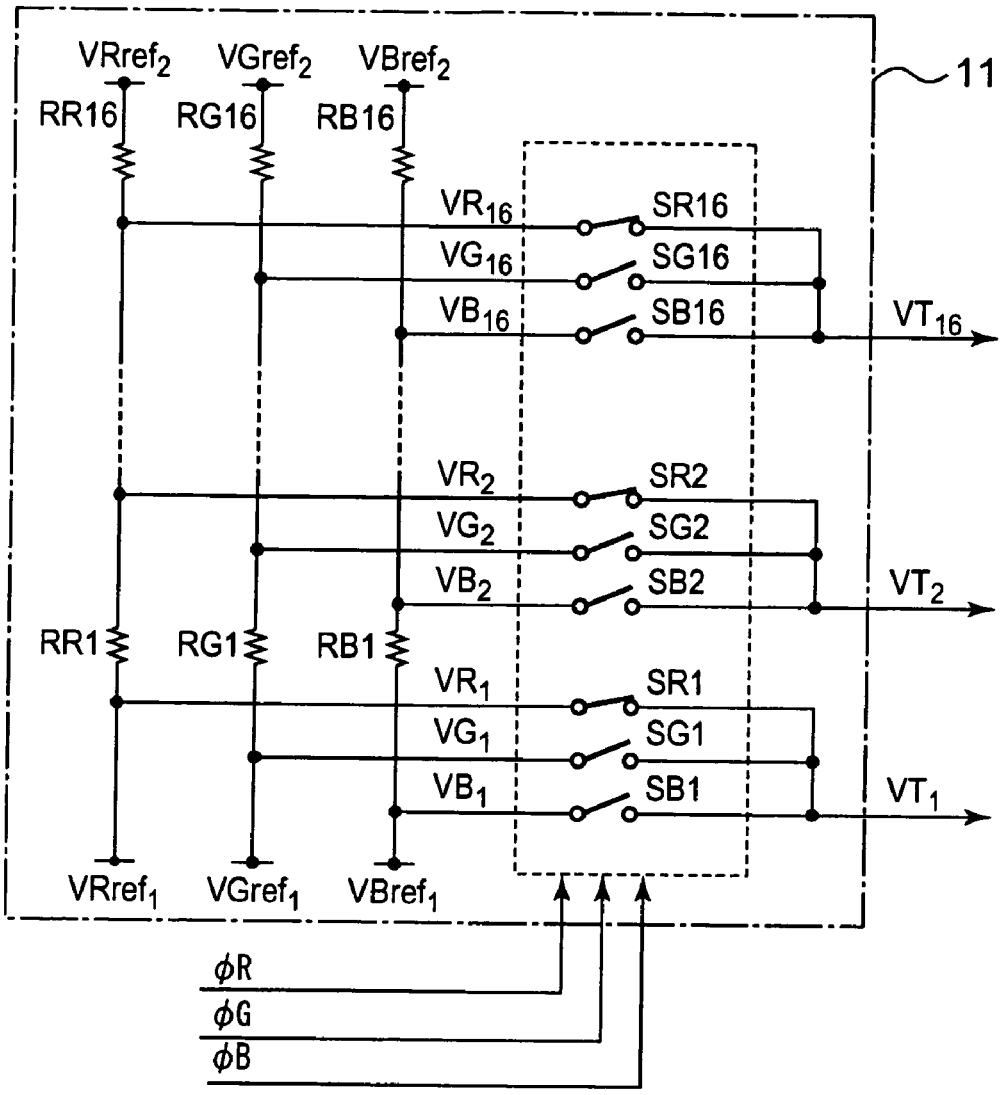
FIG. 6 is a diagram illustrating a configuration of a gamma circuit according to a second embodiment of the present invention.
Figure 7:
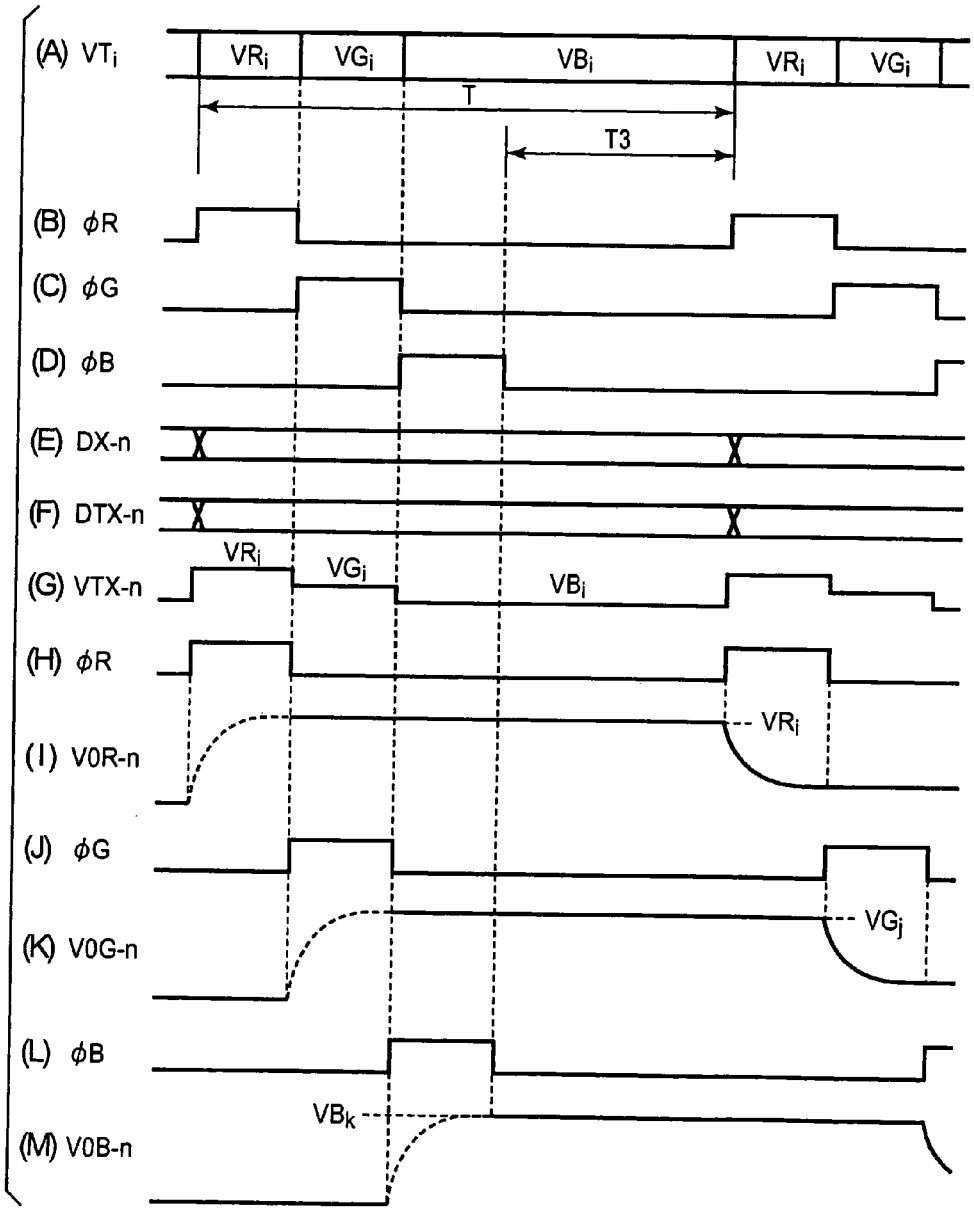
FIG. 7 is a time chart illustrating operation of a display control circuit according to a second embodiment of the present invention.

Referring to FIGS. 5 to 7, a second embodiment will be described below. The second embodiment relates to multiple-color display, where gray scale voltages of three primary colors of red (R), green (G) and blue (B) are produced independently. FIG. 5 is a schematic block diagram illustrating a configuration of a display control circuit and a display panel according to the second embodiment of the present invention. The display control circuit includes the gamma circuit 11 and gray scale selection drive circuits 21-1 to 20-N to display data D-1 to D-N on the display panel 30. The display panel 30 displays one pixel in three colors (red: R, green: G and blue: B), where respective colors are described as 16 gray colors.

Display data D-1 to D-N include R-component data DR-1 to DR-N and G-component data DG-1 to DG-N and B-component data DB-1 to DB-N respectively. Voltages indicating gray scales designated with R-component data DR-1 to DR-N, G-component data DG-1 to DG-N and B-component data DB-1 to DB-N of the display data are selected from gray scale voltages VR1 to VR16, VG1 to VG16 and VB1-VB16 produced by the gamma circuit 11. The gray scale voltages are supplied through the gray scale wirings VT1 to VT16 from the gamma circuit 11. The selected gray scale voltage is power-amplified and supplied to the display panel 30, where N corresponds to the number of pixels of one line of the display panel 30. Moreover, a portion subsequent to a symbol "–" indicates a circuit number and is omitted for description if the circuit is not required to be classified. Where any of respective components of R, G and B is indicated, it is described as a component X.

The display panel 30 has display elements of three colors R, G and B for each pixel (32-1 to 32-N) therein. That is, the pixel 32-1 includes an element indicating a red component, an element indicating a green element and an element indicating a blue component and can be electrically indicated by panel loads 31R-1, 31G-1 and 31B-1 to be simulated respectively. Pixels 32-2 to 32-N include panel loads 31X-2 to 31X-N simulating elements for displaying red, green and blue components in the same way as for the pixel 32-1. The respective panel loads 31X are simulated with a resistor 34X and a capacitance 35X.

The gamma circuit 11 produces a gray scale voltage independently for each color element. The gamma circuit 11, as illustrated in FIG. 6, includes resistors RR1 to RR16, RG1 to RG16, RB1 to RB16 and switches SR1 to SR16, SG1 to SG16, SB1 to SB16. The resistors RR1 to RR16 are connected to each other in series, and reference voltages Vref1 to Vref2 are resistance-divided to produce gray scale voltages VR1 to VR16 of R component. The resistors RG1 to RG16 are connected to each other in series, and reference voltages Vref1 to Vref2 are resistance-divided to produce gray scale voltages VG1 to VG16 of G component. The resistors RB1 to RB16 are connected to each other in series, and reference voltages Vref1 to Vref2 are resistance-divided to produce gray scale voltages VB1 to VB16 of B component. The produced gray scale voltages VRi, VGi, VBi are outputted to a gray scale wiring VTi (i=1 to 16) through the switches SRi, SGi, SBi. The switch SRi is on/off controlled by a gray scale change-over timing signal CKR. The switch SGi is on/off controlled by a gray scale change-over timing signal CKG. The switch SBi is on/off controlled by a gray scale change-over timing signal CKB. The gray-scale change-over timing signals CKR, CKG, CKB have a different phase from each other, which causes the switches SRi, SGi, SBi not to turn on at the same time. That is, the voltage applied to the gray scale wiring VTi is changed over in the order of VRi, VGi, VBi in response to gray scale change-over timing signals CKR, CKG, CKB. Accordingly, the gamma circuit 11 switches gray scale voltages to voltages for R component, G component and B component and time-multiplexes them in the gray scale wiring VTi for output.

The gray scale selection drive circuit 21-1 includes gray scale selection drive circuits 20R-1, 20G-1, 20B-1. The gray scale selection drive circuits 20R-1, 20G-1, 20B-1 have the same configuration and perform the same operation, and are described hereinafter as a gray scale selection drive circuit 20X, where X is replaced by R, G, B. The gray scale selection drive circuit 20X includes a decoder circuit 24X, gray scale selector circuit 22X and a drive circuit 40X. A display data DX is inputted into the decoder circuit 24X. The gray scale selection signal DTX decoded by the decoder circuit 24X is outputted into the gray scale selector circuit 22X. The gray scale selector circuit 22X inputs gray scale voltages VX1 to VX16 supplied by the gray scale wirings VT1 to VT16 and the gray scale selection signal DTX and outputs the selected gray scale voltage VTX into the drive circuit 40X. The drive circuit 40X outputs a driving signal VOX obtained by power-amplifying the selected gray scale voltage VTX to the display panel 30. The gray scale selection drive circuits 21-2 to 21-N have the same configuration as that of the gray scale selection drive circuit 21-1 respectively, description of which is omitted.

The decoder circuit 24X outputs a gray scale selection signal DTX into the gray scale selector circuit 22X on the basis of a display data DX. The gray scale selection signal DTX indicates a gray scale wiring supplied with a selected gray scale voltage. With the display data DX of "1111", a voltage of the driving signal VOX is made to correspond to the gray scale voltage VX16. With the display data DX of "0000", it is made to correspond to the gray scale voltage VX1. The corresponding relationship is the same between R, G and B, however, the gray scale voltages VRi, VGi and VBi selected by this are different from each other.

The gray scale selector circuit 22X selects any voltage of the gray scale wirings VT1 to VT16 on the basis of the gray scale selection signal DTX outputted from the decoder circuit 24X. The selected gray scale voltage is outputted to the drive circuit 40X as the selected gray scale voltage VTX. If the data DX is on an i grade scale, the gray scale selector circuit 22X selects a gray scale wiring VTi. A voltage of the selected gray scale wiring VTi is outputted to the drive circuit 40X as the selected gray scale signal VTX. Accordingly, the selected gray scale signal VTX outputted from the gray scale selector circuit 22X corresponds to a voltage supplied from the gamma circuit 11 to indicate a gray scale voltage VXi.

The drive circuit 40X has the same configuration as the one described in the first embodiment. The drive circuit 40X, as illustrated in FIG. 3, includes the amplifier 41, the capacitor 43 and the switches 45 to 48. A selected gray scale signal VTM (corresponding to VTX in FIG. 5) inputted into the drive circuit 40X is connected to the non-reversed input terminal of the amplifier 41 and the switch 46 through the switch 45. The other terminal of the switch 46 is connected to the switch 47 and the capacitor 43. The other terminal of the capacitor 43 is grounded. The other terminal of the switch 47 is connected to the switch 48, the output terminal and the reversed input terminal of the amplifier 41. The other terminal of the switch 48 is the output terminal of the drive circuit 40X and is connected to the display panel 30. The amplifier 41 is formed with a voltage follower circuit to drive a load of the display panel 30 by performing signal power amplification. The capacitor 43 is charged by the switches 45 to 47 to be opened and closed and holds a charged voltage. That is, the capacitor 43 functions as an analog memory.

The switch 48 is opened and closed in response to a gray scale change-over timing signal CKX. The switch 48 permits the gray scale change-over timing signal CKX to close at a low level, so that an output of the amplifier 41 is supplied to the display panel 30. With the gray scale change-over timing signal CKX at a high level, the switch 48 is opened, thus not supplying a gray scale voltage to the display panel 30.

The switches 45 to 47 are opened and closed in response to a switch change-over signal ϕX. The switch change-over signal ϕX is the same as the gray scale change-over timing signal CKX in this embodiment. With the switch change-over signal ϕX at a high level, the switches 45 and 47 are closed and the switch 46 is opened. With the switch change-over signal ϕX at a low level, the switches 45 and 47 are opened and the switch 46 is closed.

Accordingly, during a period for which a gray scale change-over timing signal CKX is high, the switch 45 is closed, so that a selected gray scale signal VTM is supplied to the amplifier 41. The output is supplied to the capacitor 43 through the switch 47. The capacitor 43 is charged (discharged) to the same voltage as for the selected gray scale signal VTM. That is, a gray scale voltage transmitted to the capacitor 43 as the selected gray scale signal VTM is stored.

With the gray scale change-over timing signal CKX at a low level, the switches 45 and 47 are opened and the switch 46 is closed. Accordingly, a voltage stored in the capacitor 43 is supplied into a non-reversed input terminal of the amplifier 41 through the switch 46. The amplifier 41 outputs a power-amplified gray scale voltage. At this time, the switch 48 is closed, and the power-amplified gray scale voltage is supplied to the display panel 30 through the switch 48. Accordingly, a voltage corresponding to a gray scale indicated by a display data DX is applied to a panel load 31X, namely, the resistor 34 and a capacitor/wiring capacitance 35X.

In this way, the respective gray scale selection drive circuits 20R-1, 20G-1, 20B-1 apply voltages corresponding to gray scales indicated by the respective display data DR-1, DG-1, DB-1 to panel loads 31R-1, 31G-1, 31B-1 in the gray scale selection drive circuit 21-1. This permits a pixel 32-1 to be displayed in multiple colors. In the gray scale selection drive circuits 21-2 to 21-N, pixels 32-2 to 32-N are displayed in the same way.

Referring to FIG. 7, the operations of the display control circuit will be described below. FIG. 7 illustrates timings of respective signals in a gray scale selection drive circuit 21-n (n=1 to N). FIG. 7A illustrates a state of a gray scale voltage supplied through a gray scale wiring VTi. FIGS. 7B, 7C and 7D illustrate gray scale change-over timing signals CKR, CKG, CKB. FIG. 7E illustrates states of display data DR-n, DG-n, DB-n inputted in gray scale selection drive circuits 20R-n, 20G-n, 20B-n as a state of DX-n. FIG. 7F illustrates states of gray scale selection signals DTR-n, DTG-n, DTB-n outputted by decoder circuits 24R-n, 24G-n, 24B-n as a state of DTX-n. FIG. 7G illustrates states of voltages of selected gray scales signals VTR-n, VTG-n, VTB-n outputted from gray scale selector circuits 22R-n, 22G-n, 22B-n as a state of a selected gray scale signal VTX-n. FIGS. 7H and 7I, FIGS. 7J and 7K and FIGS. 7L and 7M illustrate switch change-over signals ϕX-n and driving signals VOX-n for R component, G component and for B component, respectively.

As illustrated in FIG. 7A, one horizontal period for which one line of the display panel 30 is displayed is indicated with a period T. One cycle of gray scale change-over timing signals CKR, CKG and CKB is one horizoltal period. During the period T, the gray scale change-over timing signals CKR, CKG and CKB are at a level high enough not to overlap each other as illustrated in FIGS. 7B, 7C and 7D, where the signals are at a high level only during the same period in the order of RGB, and a period for which all the gray scale change-over timing signals are at a low level is T3. During the period T3, the display panel 30 incorporates a gray scale voltage supplied by a driving signal VOX.

Gray scale voltages VXn (X: R/G/B, n:1 to 16) outputted from the gamma circuit 11, as illustrated in FIG. 7A, are transmitted in a time division manner through 16 gray scale wirings VTn (n: 1 to 16). That is, a voltage of a gray scale i of each RGB is applied to a gray scale wiring VTi and supplied to the gray scale selection drive circuits 21-1 to 21-N.

Moreover, display data D-n includes DR-n, DG-n, DB-n (collectively designated as DX-n) as RGB component data and, as illustrated in FIG. 7E, a content changes at the leading edge of one horizontal period T. A gray scale selection signal DTX-n selects the gray scale wiring VTi for transmitting a gray scale indicated by the display data DX-n. Accordingly, as illustrated in FIG. 7F, the gray scale selection signal DTX-n as well changes at the leading edge of one horizontal period T. The gray scale selection signal DTX-n selects the gray scale wiring VTi, so that the selected gray scale signal VTX-n is outputted. The selected gray scale signal VTX-n, as illustrated in FIG. 7G, synchronizes with a gray scale change-over timing signal CKX and the voltage is switched. In other words, a selected gray scale signal VTX-n synchronizes with a gray scale change-over timing signal CKR, then a gray scale voltage VRi and a gray scale change-over timing signal CKG and a gray scale voltage VGi and a gray scale change-over timing signal CKB in order, and is switched to a gray scale voltage VBi.

A drive circuit 40X-n incorporates and stores a corresponding voltage of the switched gray scale voltages VXi at a timing given by a switch change-over signal ϕX-n. In other words, a drive circuit 40R-n, as illustrated in FIGS. 7H and 7I, when a switch change-over signal ϕR-n is at a high level, the switches 45, 47 are closed to store a voltage (VRi) of a selected gray scale signal VTR-n in the capacitor 43. When the switch change-over signal ϕR-n is at a low level, the switches 45, 47 are opened and the switch 46 is closed. The drive circuit 40R-n is power-amplified by power-amplifying the voltage stored in the capacitor 43 with the amplifier 41 for output. The switch 48 is closed when the gray scale change-over timing signal CKR is at a low level, so that a gray scale voltage VRi is applied to a panel load 31R-n.

Similarly, if a green color is a gray scale j, a drive circuit 40G-n, as illustrated in FIGS. 7J and 7K, the switches 45, 47 are closed when a switch change-over signal ϕG-n is at a high level, and a voltage (VGj) of a selected gray scale signal VTG-n is stored in the capacitor 43. With the switch change-over signal ϕG-n at a low level, the switches 45, 47 are opened and the switch 46 is closed. The drive circuit 40G-n power-amplifies the voltage stored in the capacitor 43 with the amplifier 41 for output. The switch 48 is closed with a gray scale change-over timing signal CKG at a low level, and the gray scale voltage VGj is applied to a panel load 31G-n.

If a blue color is a gray scale k, as illustrated in FIGS. 7L and 7M, the switches 45, 47 are closed with a switch change-over signal ϕB-n at a high level in the same for a drive circuit 40B-n, so that a voltage (VBk) of a selected gray scale signal VTB-n is stored in the capacitor 43. With the switch change-over signal ϕB-n at a low level, the switches 45, 47 are opened and the switch 46 is closed. The drive circuit 40B-n power-amplifies the voltage stored in the capacitor 43 with the amplifier 41. The switch 48 is closed when a gray scale change-over timing signal CKB is at a low level, so that a gray scale voltage VBk is applied to a panel load 31B-n.

This embodiment describes that the switch 48 closes when gray scale change-over timing signals CKR, CKG, CKB are at a low level in the driver circuits 40R, 40G, 40B, however, the switch may close only during a period T3 by combining phases of changes in three colors.

Gray scale voltages designated in panel loads 31R-n, 31G-n, 31B-n are applied in this way, so that a pixel 32-n is displayed in multiple colors. The voltage of the capacitor 43 is connected only to a non-reversed input terminal of the amplifier 41 having high impedance, therefore few fluctuations occur. Thus, a stable display is possible. The above describes 16 gray scales as an example, while in the case of 1,024 gray scales, the number of gray scale wirings is conventionally 3,072 in three colors if the width of each gray scale wiring is 1 μm, so that the overall width becomes 3 mm. The present invention multiplexes RGB, thus shrinking the width of the gray scale wiring from 3 mm to 1 mm.

The second embodiment describes multiple-color display, where the number of gray scale wirings can be further reduced by multiplexing the gray scales of each color with even-numbered/odd-numbered gray scales in the same way as for the first embodiment in this multiple-color display. At this time, the time assigned to one gray scale voltage is reduced, however, as found in the present invention, a stable gray scale voltage can be supplied by storing and reproducing an analog voltage. Accordingly, fluctuations in gray scale voltages can be suppressed while the number of wirings for supplying gray scale voltages being further reduced, thus providing better image quality without generation of color errors.

Third Embodiment

Figure 8:
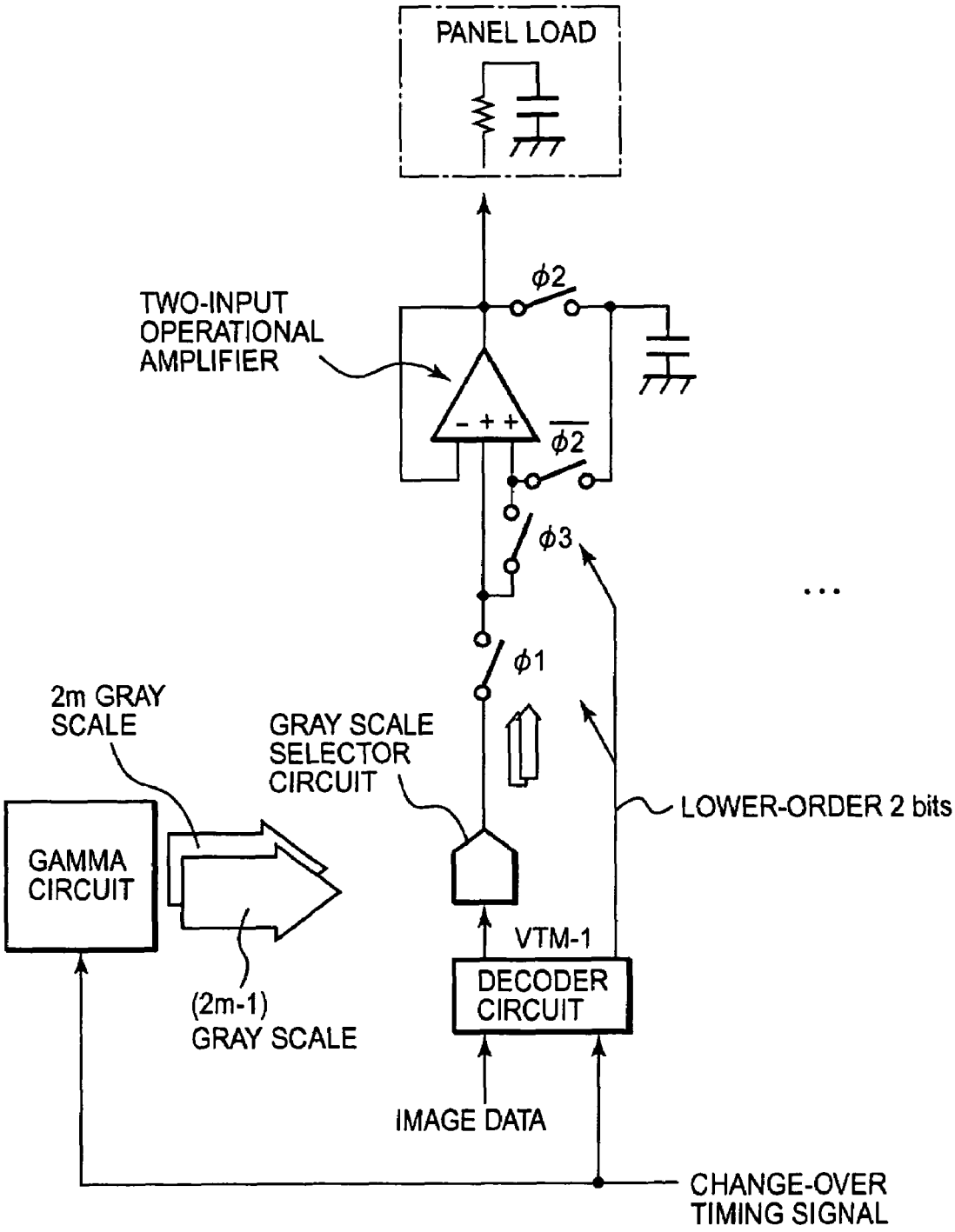
FIG. 8 is a schematic block diagram illustrating a configuration of a display control circuit and a display panel according to a third embodiment of the present invention.

FIG. 8 illustrates another embodiment using a two-input operational amplifier.

The two-input operational amplifier, as disclosed in Japanese Patent Laid-Open No. 2001-34234, is an operational amplifier which permits the output voltage to be approximately (Vin1+Vin2)/2, for example, if Vin1 and Vin2 are inputted.

The operation is described on the basis of timing charts in FIGS. 9 to 13.

Figure 9:
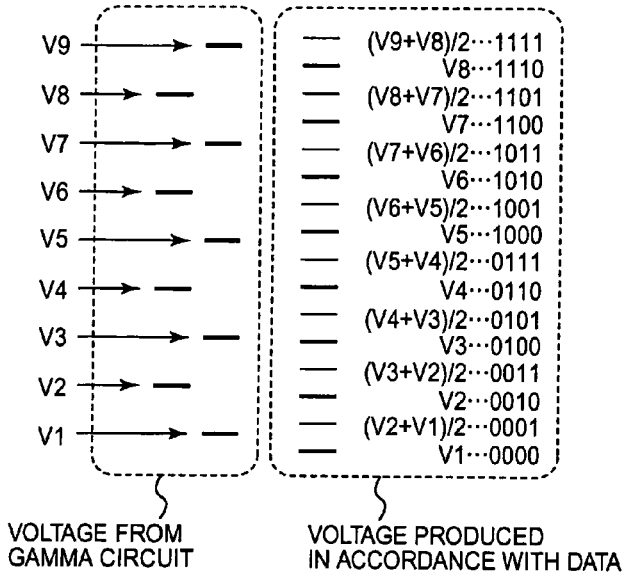
FIG. 9 is a view illustrating a relationship between an output voltage of a gamma circuit and a voltage transmitted to a panel in accordance with data, according to a third embodiment of the present invention.

This embodiment describes the operation with the assumption of 4 bits (16 gray scales) as an example. As illustrated in FIG. 9, outputs of the gamma circuit are switched to V2, V4, V6 and V8 gray scales and V1, V3, V5, V7 and V9 gray scales.

FIG. 9 illustrates a voltage image for achieving 16 gray scales.

In other words, an image data of "1111" corresponds to "(V9+V8) /2" at the 16th gray scale, while an image data of "0000" corresponds to "V1" at the first gray scale.

Figure 10:
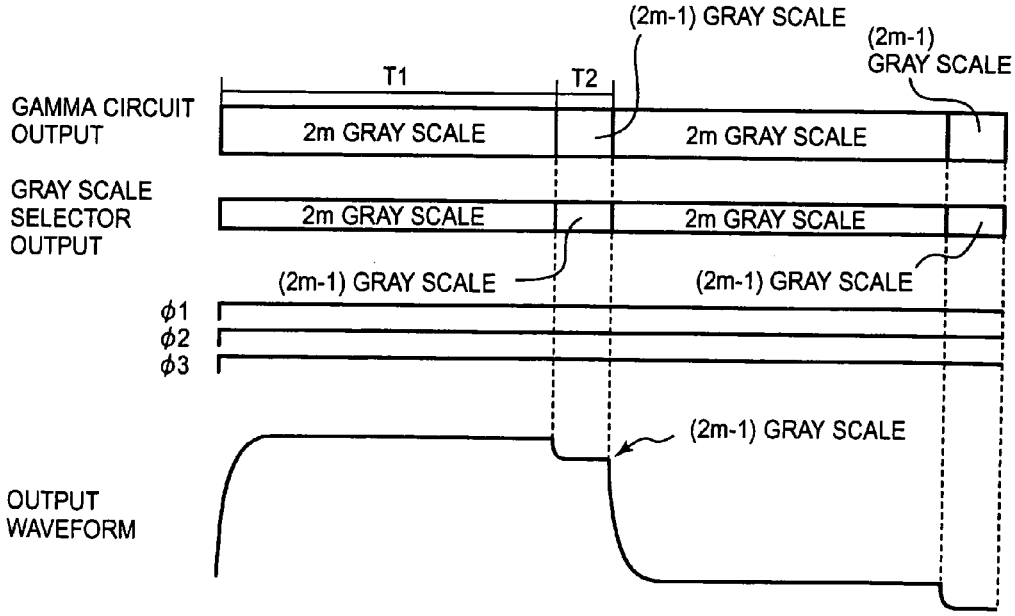
FIGS. 10 to 13 are a time chart illustrating operation of a display control circuit according to a third embodiment of the present invention, respectively.

FIG. 10 is a timing chart with two lower-order bits of an image data of "**00".

That is, FIG. 10 is a timing chart for outputting an odd-numbered gray scale. Switches corresponding to ϕ1, ϕ2, ϕ3 close during period of either T1 or T2, therefore a voltage applied to the panel is at an odd-numbered gray scale.

Figure 11:
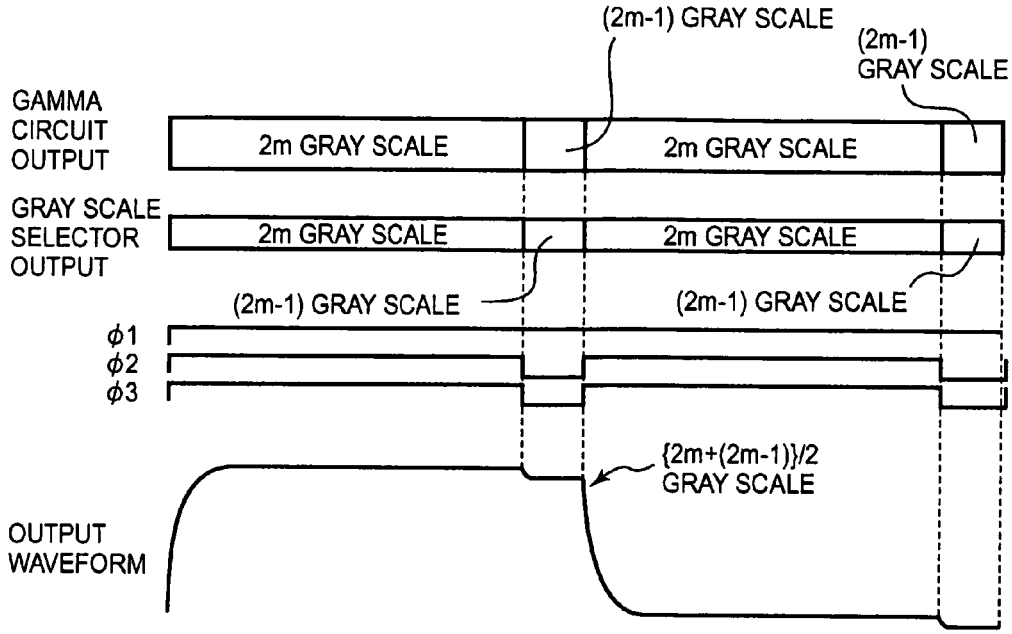

FIG. 11 is a timing chart with two lower-order bits of an image data of "**01".

That is, FIG. 11 illustrates that an even-numbered gray scale is stored in a capacitor during a period of T1 and, during a period of T2, an output voltage is produced from a voltage stored during the period T1 and a voltage applied during the period T2. For example, with an image data of "1101", two upper-order bits are "11" during the period T1, therefore V8 gray scale is selected and V8 voltage is stored in the capacitor. During the period T2, by making a gray scale selector circuit output V7 to an operational amplifier, the output voltage is "(V8+V7**)/2" at the 14th gray scale.

Figure 12:
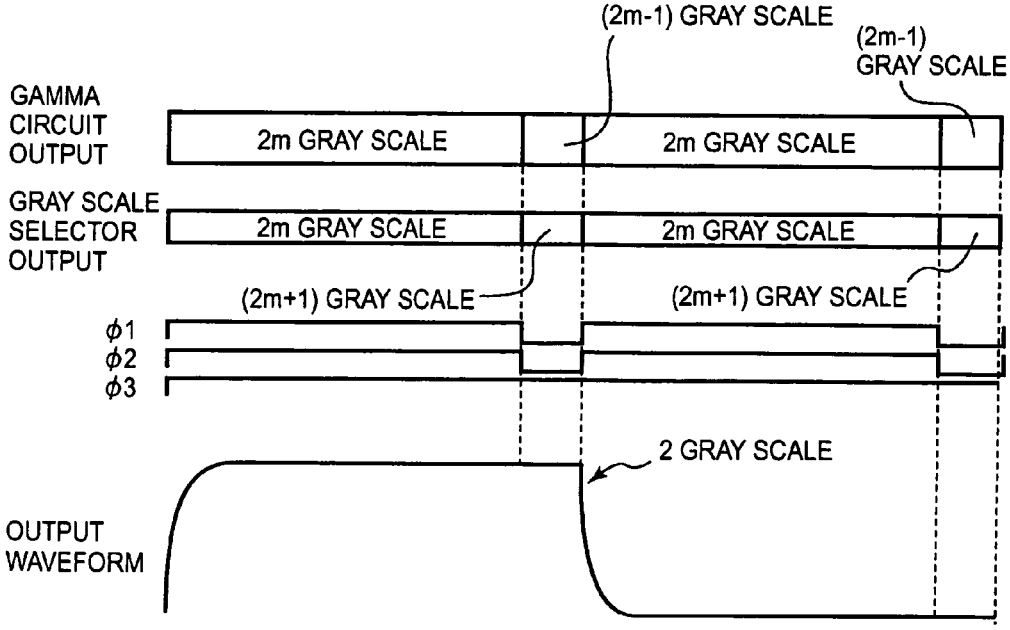

FIG. 12 is a timing chart with two lower-order bits of an image data of "**10".

That is, FIG. 12 illustrates that an even-numbered gray scale stored in the capacitor during a period of T1 is outputted through the operational amplifier during a period of T2.

Figure 13:
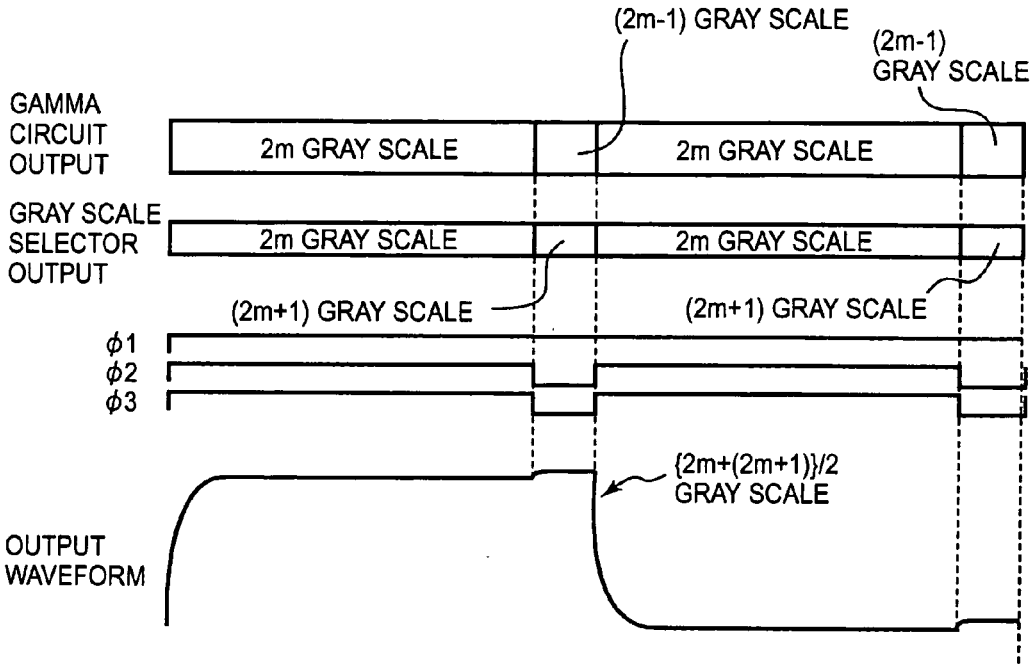
Figure 14:
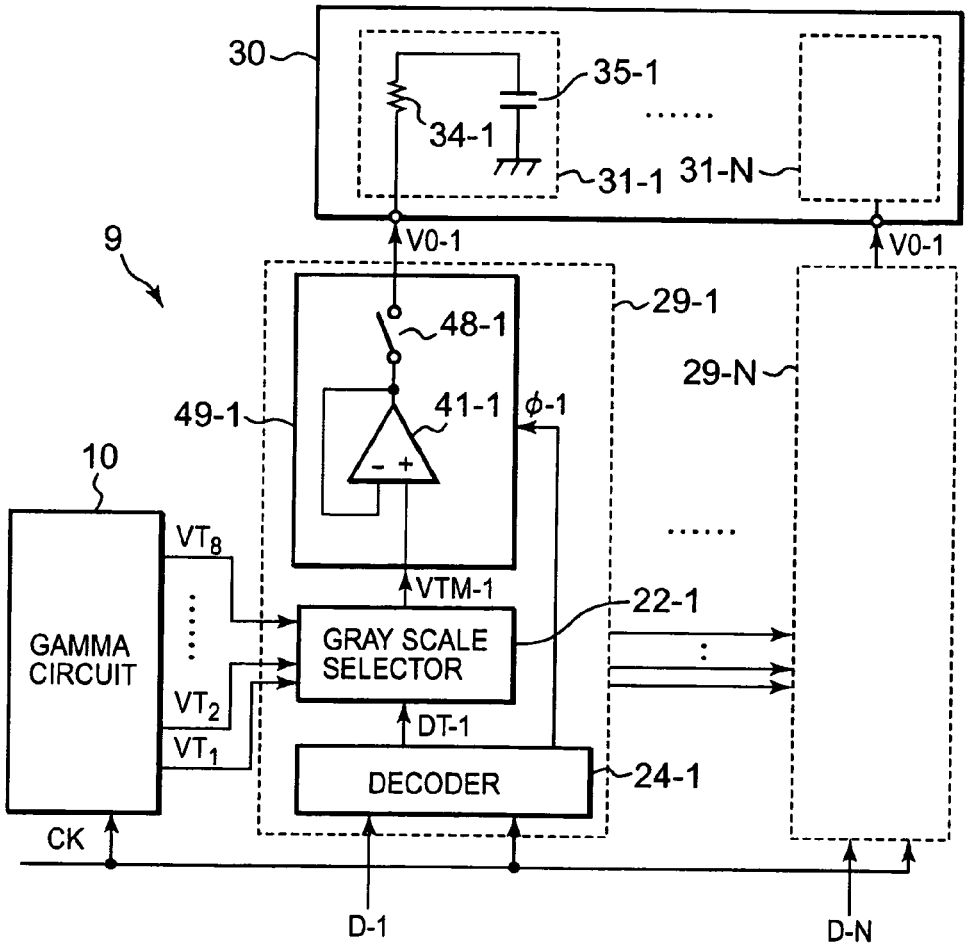
FIG. 14 is a schematic block diagram illustrating a conventional configuration of a display control circuit and a display panel.

FIG. 13 is a timing chart with two lower-order bits of an image data of "**11".

That is, FIG. 13 illustrates that an even-numbered gray scale is stored in the capacitor during a period of T1 and an output voltage is produced, during a period of T2, from the voltage stored during the period T1 and a voltage applied during the period T2. For example, with an image data of "1111", two upper-order bits are "11" during the period T1, therefore V8 gray scale is selected and V8 voltage is stored in the capacitor. During the period T2, by making the gray scale selector circuit output V9 to the operational amplifier, the output voltage is "(V9+V8**)/2" at the 16th gray scale. Such a circuit configuration can restrain a chip area from being increased by an increase in the number of bits.

Although the invention has been described with reference to specific embodiments, this description is not meant to be construed in a limiting sense. Various modifications of the disclosed embodiments will become apparent to persons skilled in the art upon reference to the description of the invention. It is therefore contemplated that the appended claims will cover any modifications or embodiments as fall within the true scope of the invention.

What is claimed is:

1. A display control device comprising:

a gamma circuit producing and outputting a gray scale voltage and a selection drive circuit selecting the gray scale voltage on the basis of a pixel data displayed on a display device and outputting the selected gray scale voltage as a pixel driving signal to the display device, wherein the selection drive circuit includes an analog memory and holds the selected gray scale voltage in the analog memory; and wherein the drive circuit comprises:

a capacitor holding an analog voltage;

a first switch supplying/shutting down a voltage supplied to the capacitor;

an amplifier supplying a voltage to be stored in the capacitor through the first switch;

a second switch supplying/shutting down a gray scale voltage to be inputted into the amplifier from the selection drive circuit; and a third switch supplying/shutting down a voltage stored in the capacitor to the amplifier;

wherein the first switch and the second switch are closed and the third switch is opened to store a gray scale voltage inputted from the selection drive circuit in the capacitor through the amplifier, and wherein the first switch and the second switch are opened and the third switch is closed to reproduce and output a voltage stored in the capacitor through the amplifier.

2. The display control circuit according to claim 1, wherein the gamma circuit outputs a plurality of gray scale voltages in a time division manner and the selection drive circuit stores a display gray scale voltage predetermined in accordance with the pixel data of the plurality of gray scale voltages to be inputted in a time division manner in the analog memory.

3. The display control circuit according to claim 1, wherein the plurality of gray scale voltages comprise even-numbered gray scale voltages and odd-numbered gray scale voltages of gray scale voltages produced by the gamma circuit.

* * * * *